US005515710A

United States Patent [19]

Larikka

[11] Patent Number: 5,515,710

[45] Date of Patent: May 14, 1996

[54] DEVICE FOR FLARING OUT PIPES

[75] Inventor: Leo Larikka, Vantaa, Finland

[73] Assignee: Efes Tex AG, Vantaa, Finland

[21] Appl. No.: 516,250

[22] Filed: Aug. 17, 1995

Related U.S. Application Data

[63] Continuation of Ser. No. 142,334, filed as PCT/CH93/00087, Mar. 29, 1993, abandoned.

[30] Foreign Application Priority Data

Mar. 30, 1992 [CH] Switzerland ..... 999/92

[51] Int. Cl.[6] ..... B21C 37/29; B21D 19/00

[52] U.S. Cl. ..... 72/452.9; 72/370; 72/392

[58] Field of Search ..... 72/370, 392, 399, 72/452

[56] References Cited

U.S. PATENT DOCUMENTS

| | | | |
|---|---|---|---|
| 1,157,073 | 10/1915 | Baash | 72/392 |
| 1,574,900 | 3/1962 | Kellogg . | |
| 1,892,712 | 1/1933 | Taylor | 72/370 |
| 2,868,263 | 1/1959 | Marquis et al. | 72/392 |
| 2,910,897 | 11/1959 | Huet | 72/392 |
| 3,064,707 | 11/1992 | Walts . | |
| 4,400,966 | 8/1983 | Eckold . | |

FOREIGN PATENT DOCUMENTS

| | | | |
|---|---|---|---|
| 1217218 | 5/1960 | France . | |
| 0437789 | 5/1949 | Italy | 72/370 |
| 0154243 | 11/1981 | Japan | 72/370 |
| 61-71133 | 4/1986 | Japan . | |
| 1134262 | 9/1983 | U.S.S.R. . | |
| 759768 | 10/1956 | United Kingdom . | |

*Primary Examiner*—David Jones
*Attorney, Agent, or Firm*—McAulay Fisher Nissen Goldberg & Kiel

[57] ABSTRACT

The device for necking pipes forces the pipe wall outward in such a way that a neck is formed around the hole. The device has a body to be inserted into the interior of the pipe and a die which is movable radially to the pipe, the outer diameter of the die corresponding to the inner diameter of the desired neck. The cylindrical outer surface of the body is dimensioned, at least in the vicinity of the necking location, in such a way that it corresponds to the cylindrical interior of the pipe so as to support the pipe from the inside during the necking operation. A bore hole or opening which is directed at least substantially radially is located at the body in the region of the cylindrical surface and is dimensioned in such a way that it receives the die or its lower part with a sliding guiding fit. The die can be moved in the guide through the bore hole or opening in the direction of the latter. An elongated wedge is displaceable in the axial direction in the interior of the body and its surface and/or groove forms a flat wedge angle with the axial direction. The lower end of the die moves in a sliding manner so as to contact said wedge surface and/or groove.

8 Claims, 4 Drawing Sheets

DEVICE FOR FLARING OUT PIPES

This is a continuation of application Ser. No. 08/142,334, filed as PCT/CH93/00087, Mar. 29, 1993, now abandoned.

BACKGROUND OF THE INVENTION a) Field of the Invention

The invention relates to a device for flaring out or necking pipes which bends the opening of the pipe wall outward in such a way that a neck is formed around the opening of the pipe wall and which has a body to be inserted into the interior of the pipe and a die which is movable radially to the direction of the pipe, the outer diameter of the die corresponding to the inner diameter of the desired neck.

b) Background Art

U.S. Pat. No. 2,910,897 shows a device for necking which is characterized by a body which is to be inserted into the interior of the pipe and has a supported turning lever. The die is located at one end of the turning lever and a radial force is applied to the other end so as to turn the lever in such a way that the die can be pushed radially outward. It is difficult to achieve the necessary penetrating force with this arrangement. Moreover, this tool construction does not support the pipe from the inside to prevent pinching and buckling.

U.S. Pat. No. 2,868,263 shows a two-part deforming tool which is to be inserted into the interior of the pipe and expanded by means of a cylindrical wedge. Deformation surfaces for necking the wall are located in one part of the tool. This tool also does not support the pipe from within during deformation. The tool is not suitable for producing necks of different sizes. It can also not be used to form necks whose diameters approximate or correspond to those of the pipe to be necked.

U.S. Pat. No. 2,983,167 shows a tool serving to produce very small necks, so-called nipples, at rigid-walled pipes. The deformation is only supported from the outside of the pipe by a relatively massive supporting construction. The deformation bayonets are evidently hydraulically actuated.

A common characteristic of these and other known methods consists in that the pipe tends to be pinched from the inside either laterally adjacent to the necking or at the back of the pipe on both sides of the necking during the necking process or branching of the pipe. This is primarily a phenomenon similar to buckling. This phenomenon also occurs when the outside of the pipe is provided with a rigid supporting casing or shell.

OBJECT AND SUMMARY OF THE INVENTION

The primary object of the present invention is to provide a device for producing necks for pipe branches with which a good, round neck for pipes of varying wall thickness and diameter and of different materials is produced in one step without causing a buckling or pinching of the portion of the pipe surrounding the neck.

In accordance with the invention, a device for necking pipes which bends the opening of the pipe wall comprises a body to be inserted in the interior of the pipe and a die which is movable radially to the pipe direction. The outer diameter of the die corresponds to the inner diameter of the desired neck. The body has a cylindrical outer surface which is dimensioned so that at least in the vicinity of the necking location, which is in the effective region of secondary effects of deformation forces, it corresponds to the inner surface of the pipe so as to support the pipe to be necked from the inside during the necking operation. The body has an at least substantially radially directed bore hole which is located in the region of the cylindrical surface and is dimensioned so that it receives at least a lower part of the die by way of a sliding guiding fit. The die can be moved in the guide through the bore hole in the direction of the bore hole. An elongated wedge, which is movable in the axial direction and having a surface or groove forming a flat wedge angle with the axial direction, is located in the interior of the body. A lower end of the die is movable in a sliding manner so as to contact the wedge surface or groove.

Typically, a device according to the invention can be used for necking small and middle-sized pipes when the wall thickness and/or material make for a particularly stable pipe. On the other hand, a device according to the invention can also be used for necking more elastic pipes of large or small diameters even when the diameter of the neck corresponds to the diameter of the pipe to be necked.

A number of embodiment forms of the invention are explained in more detail in the following with reference to the drawings.

DESCRIPTION OF THE PREFERRED EMBODIMENTS

Figure 1:
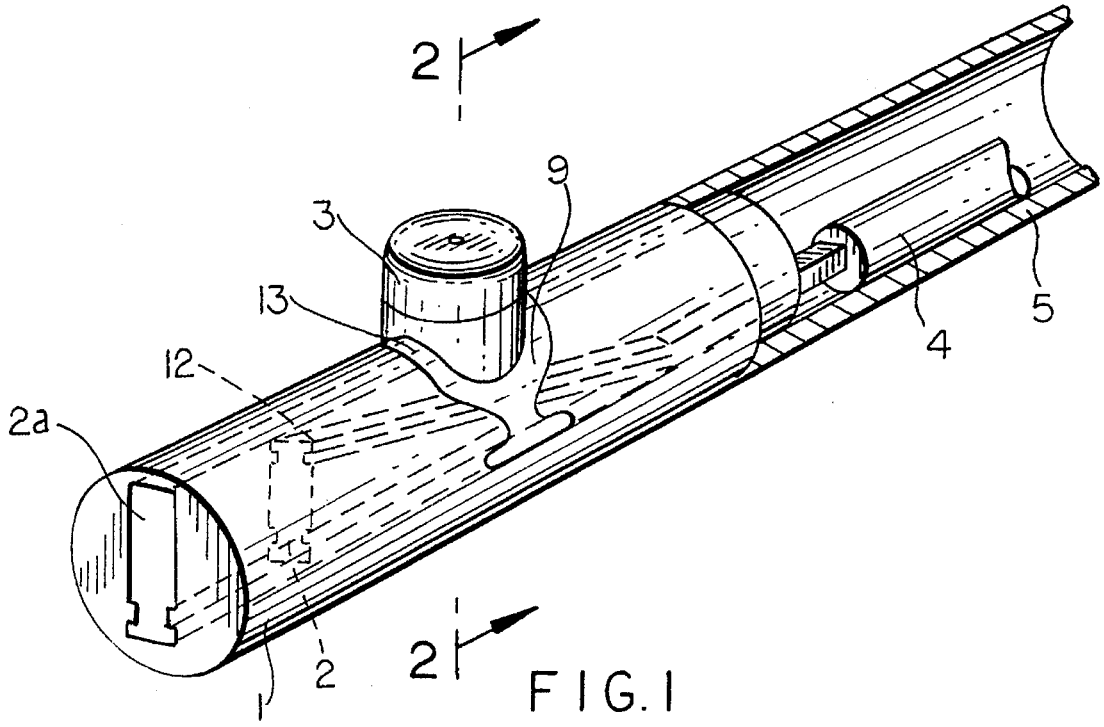
FIG. 1 shows a view in perspective and partially in section of a device according to the invention in a first embodiment example.
Figure 2:
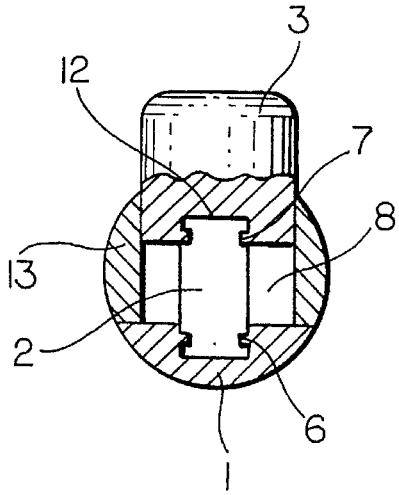
FIG. 2 shows a section along line II—II in FIG. 1.
Figure 2A:
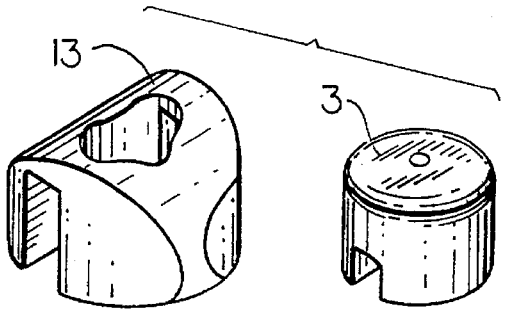
FIG. 2A shows an embodiment form of the die as used in the device according to FIGS. 1 and 2.

In the embodiment form according to FIGS. 1 and 2, the body 1 of the device is formed by a cylindrical part in which a bore hole 2*a* of rectangular cross section passes through the entire body 1 in the longitudinal direction. The bore hole 2*a* extends as near as possible to the surface at the upper side of the body 1 and more material remains under the bore hole 2*a* at the lower side so as to lend strength to the body 1. The cylindrical surface of the body has a substantially radially aligned bore hole or opening 9 situated in the center with reference to the longitudinal bore hole 2*a*. The bore hole or opening 9 is located on the thinner side of the body 1. It can also lie at an optional angle between 90° and 45° relative to the central axis of the body 1. However, frontal (radial) pipe branches and necks are most commonly used and, in this case, the angle between the central axis of the bore hole or opening 9 and the longitudinal axis of the body is 90°. An elongated wedge 2 is arranged in the bore hole 2*a* of the body 1 and can move in the axial direction of the body 1 in such a way that the straight undersurface of the wedge 2 is supported against the underside of the bore hole 2*a* and the lateral surfaces of the bore hole engage in corresponding grooves of the wedge 2 via guides (tongues) 6 of the body. A part 3 which is shaped cylindrically or in some other manner and serves as a die is fitted in the bore hole or opening 9. A groove corresponding to the width of the wedge 2 is situated at the underside of this part 3, its base being inclined in such a way that it contacts the upper side 12 of the wedge 2 along its entire length when the die 3 is arranged in the bore hole or opening 9. The die 3 fitted in the bore hole or opening 9 engages the wedge 2 by means of guides (tongues) 7 which slide in grooves adjacent to the upper side of the wedge 2.

When the wedge 2 is compelled to move in the longitudinal direction relative to the bore hole 2*a* of the body 1 in such a way that the thicker end of the wedge 2 approaches the die 3, the die 3 is pushed out of the body 1 so as to be guided through the lateral bore hole or opening 9 itself or through the bore hole in an intermediate sleeve 13 mounted therein. When the wedge 2 is moved in the opposite direction so that the thinner end of the wedge approaches the die, the die 3 is drawn back into the body 1 by the guides 6 and 7.

During the necking operation, the pipe to be necked, which has a suitable opening, is slid over the body 1 so that the opening lies centrically over the die 3 located in the bore hole or opening 9. When the wedge 2 is compelled to move in such a way that its thicker end approaches the die 3, the die 3 is pushed outward and forces the pipe wall outward around the rim of the opening. The pipe wall begins to spread or stretch around the rim of the opening and forms, in relation to the cylindrical pipe, a connecting branch, i.e. a neck, whose shape and direction corresponds to the shape and direction of the die 3 being pushed out.

When the diameter of the body 1 corresponds to the inner diameter of the pipe, it supports the pipe from the inside and prevents a buckling of the pipe at the upper part, a pinching on the sides, and a distortion of the pipe. Naturally, the pipe can also be supported from the outside if necessary.

When the wedge 2 is compelled to move back, the die 3 withdraws into the body 1, whereupon the necked pipe can be removed from the body 1.

Clearly, the bore hole or opening 9 and the die 3 fitted therein can correspond to the diameter of any desired pipe branch, that is, can substantially correspond to or be smaller than the diameter of the body 1.

In practice, it may be necessary to arrange branches of many different sizes on a determined pipe size. Consequently, there is a need for producing necks of different diameters for a determined diameter of pipe, e.g. for a ø 50-mm pipe, branches for ø 48, 32, 25, 21, 17, 15 mm, etc. If it were necessary to produce separate bodies 1 and wedges 2 for each branch, the cost of the work devices would be high. The number of and cost for the devices can be reduced in that the lateral bore hole or opening 9 has a maximum size and by using intermediate sleeves 13 having a bore hole in which the actual die 3 is fitted. Accordingly, the bore hole size of the intermediate sleeves 13 and, consequently, the diameter of the die can vary. The direction of the lateral bore hole or necking can also be changed with the intermediate sleeves.

The body 1 and wedge 2 can be connected with a driving arrangement, not shown, e.g. with a pulling and pushing cylinder, via lengthening or extension pieces 4 and 5. This driving arrangement can be any desired mechanical actuator whose parts 4 and 5 can be moved back and forth axially relative to one another.

Figure 3:
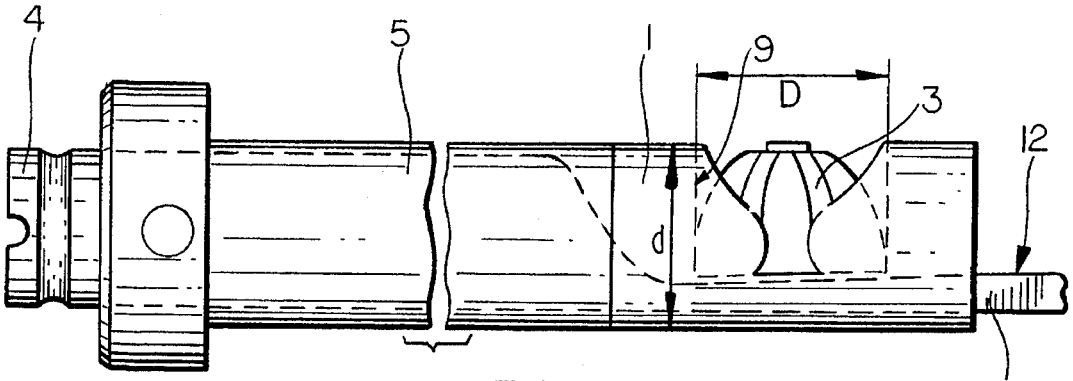
FIG. 3 shows a side view of another embodiment form of the device for necking.
Figure 4:
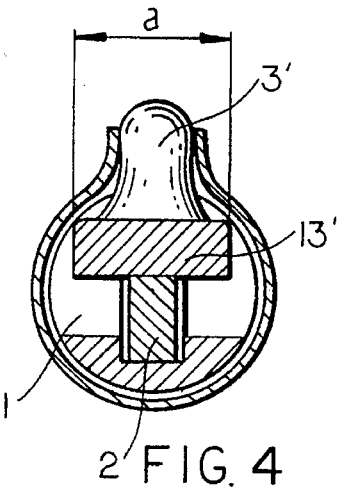
FIG. 4 shows a cross section through the device according to FIG. 3 at the location of the die.

The preceding description also essentially applies to the embodiment form according to FIGS. 3 and 4 in which the relevant parts have the same reference numbers as in FIGS. 1 and 2. The embodiment forms according to FIGS. 3 and 4 differ in that the wedge 2 has no engaging grooves relative to the body 1 or die 3. This means that the die 3 must be brought back into the body from the neck by external force so that the pipe may be removed from the body 1 after necking. When the pipe to be necked is securely held during the necking operation, the extension pieces 5 and 4 of the body 1 and wedge 2 must be fastened at the driving arrangement which moves the body 1 and wedge 2 in the axial direction in such a way that the body 1, along with the wedge 2, can be pushed into the pipe. The extension pieces 4 and 5 must be sufficiently long so that the body 1 can be pushed into the bore hole as far as necessary.

Figure 4A:
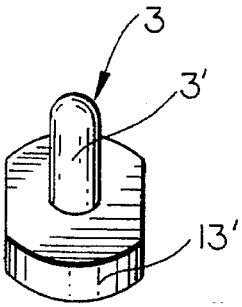
FIGS. 4A–4C show various embodiment forms of the die having a lower part 13' of similar dimensions, but with pressure tips 3' of varying thickness.
Figure 4B:
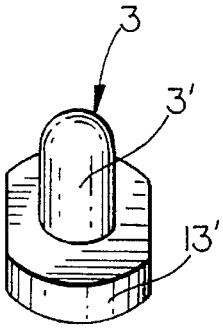
Figure 4C:
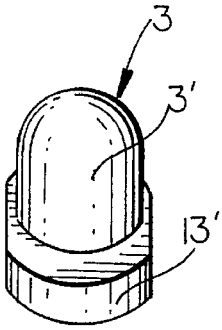
Figure 4D:
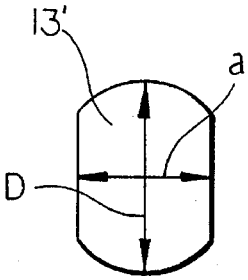
FIG. 4D shows the lower part of the die as seen from below.
Figure 4E:
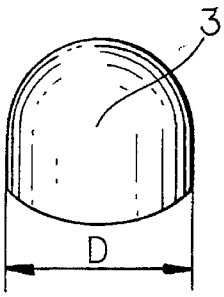
FIGS. 4E–4F is a perspective view, as seen from below, of a die of the device which is used for forming necks corresponding to the pipe diameter.
Figure 4F:
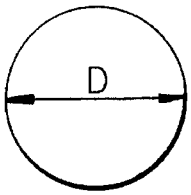

As shown in FIGS. 4A–4C, the separate guide sleeve 13 can be replaced by a lower part 13' of standard size on which pressure tips 3' of various sizes can be fastened. The lower part 13' of the die which is designated in its entirety by 3 has a greater diameter D which is somewhat greater than the diameter d of the body 1. The greater diameter D corresponds to the diameter of the bore hole or opening 9 at the body 1. The die 3 shown in FIGS. 4E and 4F can also be mounted in the bore hole or opening 9. This die 3 is round in cross section and its diameter D, which corresponds to the diameter of the bore hole 9, is greater than the diameter d of the body 1. In this instance, the sides of the die 3 at the sides of the body 1 can also be seen somewhat at the height of its center axis. The die 3 (diameter D), which is greater than the inner diameter of the body 1 and consequently also greater than the inner diameter of the pipe to be necked, is used when necks similar in size to the branched pipe itself are to be produced, since the material of the branching neck must be stretched somewhat beyond its final size. In such cases, it is difficult to insert the working device into the pipe without special arrangements.

Figure 5:
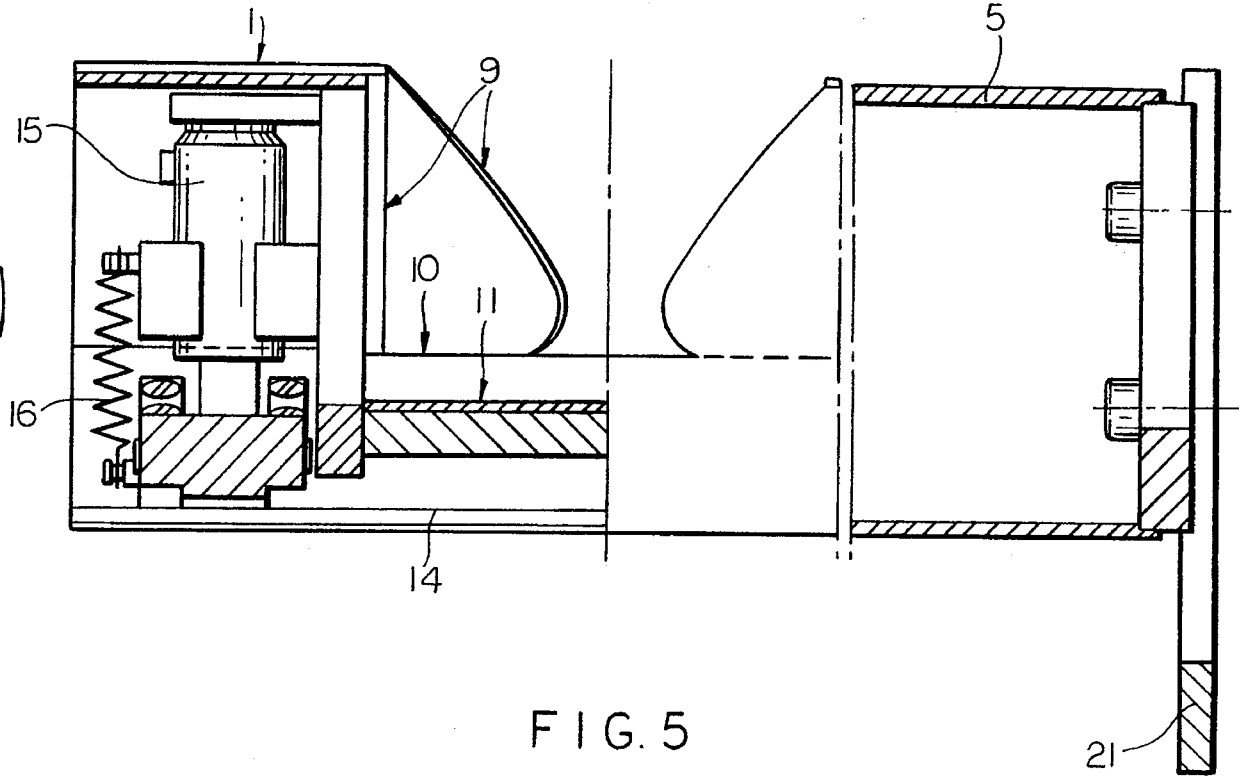
FIG. 5 shows a longitudinal section through a device for necking according to a third embodiment form which is used for forming necks corresponding to the pipe diameter in elastic pipes of large diameter.
Figure 6:
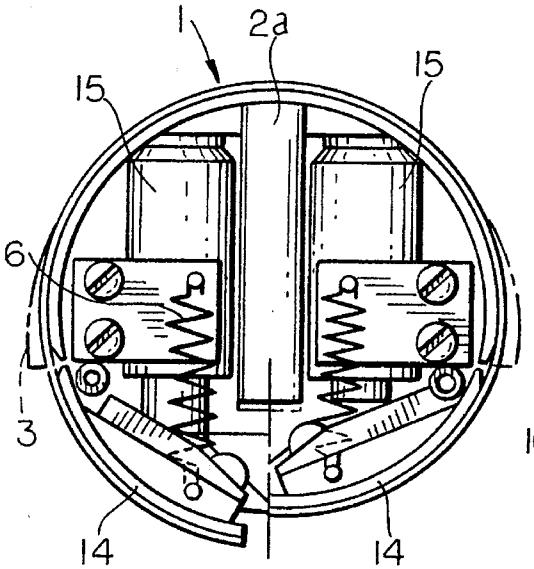
FIG. 6 shows the device according to FIG. 5 as seen from the end of the pipe.
Figure 7:
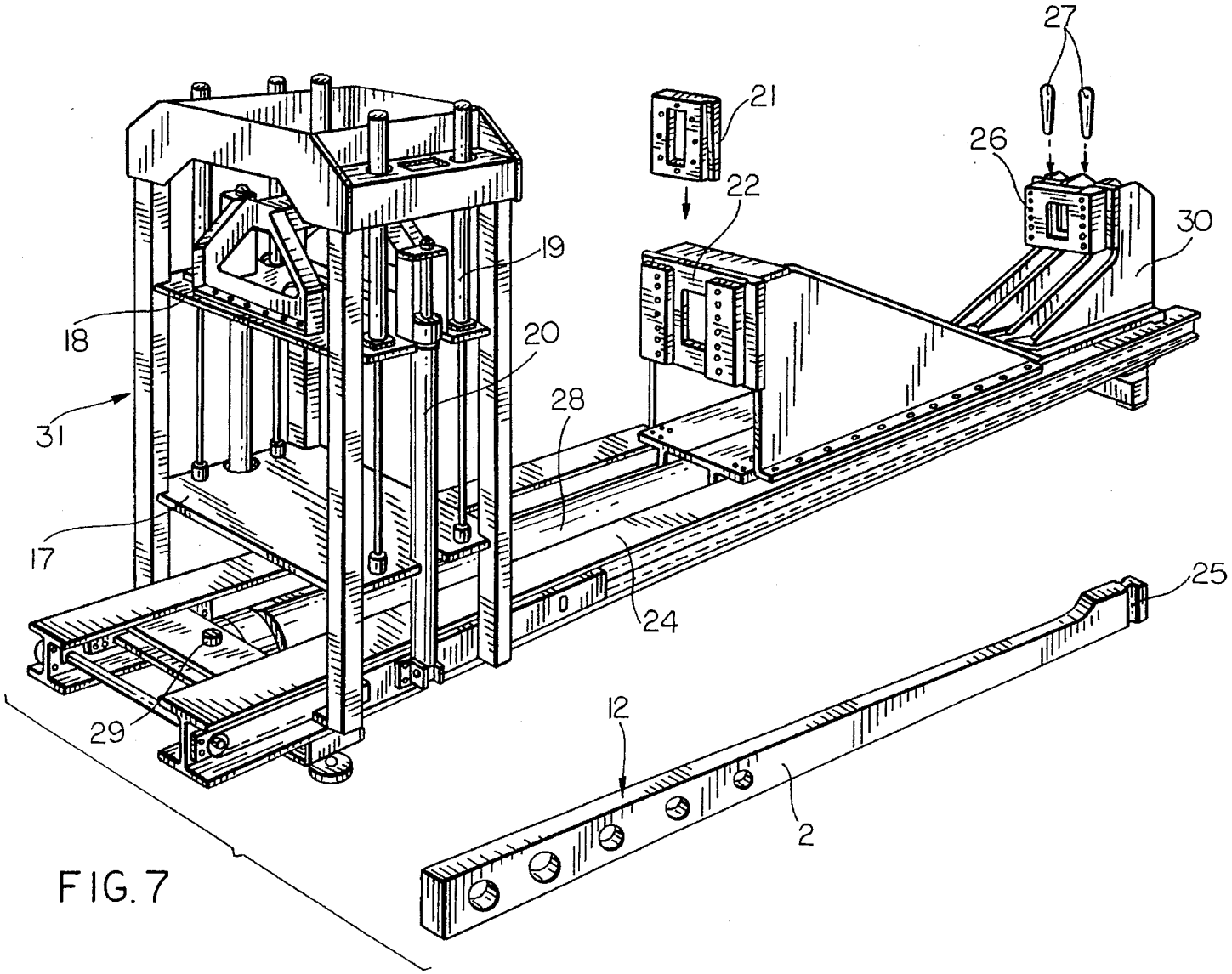
FIG. 7 shows one of many possible embodiment forms of a driving arrangement for the device according to FIGS. 5 and 6.

FIGS. 5 and 6 show a device for necking which can be pushed into the pipe to be necked by a drive according to FIG. 7 also when the outer diameter D of the die 3 exceeds the inner diameter of the pipe.

The device for necking according to FIGS. 5 and 6 is outfitted with casing or shell parts 14 which are to be drawn inward from the cylindrical surface and are situated opposite the bore hole or opening 9 with reference to the surface of the cylinder. The shell parts 14 can be drawn inward and pushed outward relative to the cylindrical outer surface area or casing of the body 1 by a hydraulic force transmitting device 15. The inward rotating movement of the shell parts 14 can also be carried out by restoring springs 16.

The underside of the bore hole or opening 9 is designated by 10 and the sliding surface of the wedge by 11. Thus, the wedge must be relatively thin between the surfaces 10 and 11 of the thinner end of the wedge. In order to withstand the occurring loads, the traction arm 4 of the wedge 2 and/or the force transmitting device (28 in FIG. 7) pulling the wedge are/is constructed so as to join the end of the wedge 2 at the lowest point of the wedge surface 12.

The device for necking is used with a drive according to FIG. 7 as follows: the body 1 is fastened, e.g. by pins or bolts, at the fastening flange 21 by means of an optional extension piece 5, the fastening flange 21 being mounted at a counter-flange 22 at the body. Accordingly, the body 1 can be pushed between plates 17 and 18 when the frame 31 is moved on the frame rails 24 in the direction of the fastening flanges 21, 22. The pipe to be necked is fastened between the plates 17 and 18. The plates 17 and 18 can be pressed together by the drives 19, 20 with a force sufficient for flattening the pipe lying between the plates 17 and 18 into an oval shape. When the pipe is flattened into an oval shape, the body 1, whose shell parts 14 are drawn inward, can be pushed into the pipe, although the die 3 projects beyond the lateral surfaces of the body as shown by dash-dot lines in FIG. 6. When the body 1 is pushed into the ovally flattened pipe as far as the location of the necking, the movement of the frame 31 is stopped and the force flattening the pipe is released with the drives 19, 20. The pipe then resumes its round shape. Small protuberances caused by the large diameter D of the die 3 may often be observed on the side of the pipe. The shell parts 14 are pressed against the inner surface of the pipe by hydraulic force transmitting devices 15, which means that the pipe is supported circumferentially against the body 1 from the inside.

The die 3 with the wedge 2 can then be pushed out of the body 1. In the example shown in FIG. 7, the fastening end 25 of the wedge 2 is fastened with the fastening pins 27 in the bore hole of the flange 26. The flange 26 is fastened in turn at the slide 30 which can be moved back and forth by a piston-cylinder device 28 whose lower end, at point 29, is fastened at the frame rails 24. The wedge 2 runs through openings in the fastening flanges 21 and 22 into the interior of the body 1 fastened at the flange 21.

The arrangement shown in FIGS. 5 to 7 is particularly suitable for necking pipes with a relatively large diameter and relatively thin walls when a neck diameter corresponding to the pipe diameter is desired. When the necking is carried out with a die of diameter D which is greater than the final diameter d, a dimension corresponding to the pipe diameter d is achieved as definitive size of the necking after compression by means of the inner coherence.

The invention does not consist only in the embodiment forms mentioned above. On the contrary, structural details may be varied in a great number of ways within the scope of the following patent claims. For example, the body 1 need not necessarily be formed from one piece. Instead, adaptor sleeves may be used at its end so that one and the same body can be adapted to different pipe diameters in small cross-sectional intervals. In this case, the bore hole or opening 9 must also be arranged in the adaptor sleeves.

While the foregoing description and drawings represent the preferred embodiments of the present invention, it will be obvious to those skilled in the art that various changes and modifications may be made therein without departing from the true spirit and scope of the present invention.

What is claimed is:

1. A device for forming a neck in a radial opening in a pipe wall, the pipe wall forming a longitudinal passage substantially perpendicular to the radial opening, the device comprising:

a cylindrical body having an outer diameter, a longitudinal axis and a longitudinal bore, the cylindrical body comprising:

a body portion including a radial opening having an inner diameter; and a casing portion moveably connected to the body portion, the casing portion being moveable in a radial direction between an extended position and a retracted position relative to the longitudinal axis of the cylindrical body, the outer diameter being determined while the casing portion occupies the retracted position, the casing portion being connectable to a driving means for urging the casing portion into the extended position, wherein the inner diameter is greater than the outer diameter;

a die having an outer diameter and a contact edge, the die being at least partially slidable within the radial opening of the body portion and moveable radially from the longitudinal axis of the cylindrical body, the body portion acting to guide the die; and, a wedge having a contact surface and a guide surface, the wedge being slidably insertable within the longitudinal bore of the cylindrical body and being moveable along an axis parallel to the longitudinal axis of the cylindrical body, the contact surface of the wedge being positioned substantially in a contact plane and the guide surface being positioned substantially in a guide plane, the contact and guide planes intersecting at a wedge angle, the contact surface of the wedge contacting the contact edge of the die.

2. A device for forming a neck in a radial opening in a pipe wall, the pipe wall forming a longitudinal passage having an inner diameter, the longitudinal passage being substantially perpendicular to the radial opening, the device comprising:

a cylindrical body having a longitudinal axis, a radial opening, an outer diameter and a longitudinal bore, the body being insertable into the longitudinal passage of the pipe to provide support to the pipe wall from within the longitudinal passage of the pipe while the neck is formed;

a die having a first section connected to a second section, the first section having an outer diameter, the second section having a greater dimension measurable in a plane substantially parallel to a plane defined by the outer diameter of the first section, a smaller dimension measurable in a direction substantially perpendicular to the greater dimension, and a contact edge, the greater dimension being greater than the inner diameter of the pipe, and the smaller dimension being less than or equal to the outer diameter of the cylindrical body, the die being moveable radially from the longitudinal axis of the cylindrical body and slidable within the radial opening of the cylindrical body;

a wedge having a contact surface and a guide surface, the wedge being slidably insertable within the longitudinal bore and being moveable along an axis parallel to the longitudinal axis of the cylindrical body, the contact surface of the wedge being positioned substantially in a contact plane and the guide surface being positioned substantially in a guide plane, the contact and guide planes intersecting at a wedge angle, the contact surface of the wedge contacting the contact edge of the die.

3. A method for using a neck forming device which includes a cylindrical body having a casing portion extendable in a first direction from the cylindrical body, a die positioned in an opening in the cylindrical body, the die being extendable radially from the cylindrical body in a direction substantially opposite to the first direction, and a wedge slidable within a longitudinal passage in the cylindrical body for contacting a contact edge of the die, said method comprising the steps of:

inserting at least the cylindrical body, the die, and at least a portion of the wedge into a longitudinal opening of a pipe;

flattening the pipe to create an oval shape while maintaining said casing portion in a retracted position;

positioning said die at a necking point inside the pipe;

extending said casing portion to contact an inner surface of the pipe; and moving the wedge to extend the die and neck the pipe.

4. A device for forming a neck at a radial opening in a wall of a pipe, the wall forming a longitudinal passage substantially perpendicular to a central axis of the radial opening in the wall, the device comprising:

a body having a longitudinal axis, a longitudinal passage, and an opening positioned radial to the longitudinal axis, the radial opening communicating with the longitudinal passage and the body being adapted for insertion into the longitudinal passage of the pipe;

a die positioned in the radial opening of the body, the die having an outer diameter and a contact surface and being slidable within the radial opening of the body;

a wedge being slidably inserted within the longitudinal passage of the body, the wedge having a contact surface and a guide surface, the contact surface of the wedge being positioned substantially in a contact plane and the guide surface being positioned substantially in a guide plane, the contact and guide planes intersecting at a wedge angle adjacent to a distal end of the wedge, the wedge being positioned so that the contact surface of the wedge contacts the contact surface of the die and the guide surface of the wedge contacts a wall of the longitudinal passage of the body, and during insertion of the wedge into the body, the die is pushed in a direction radiating from the longitudinal axis of the body toward the radial opening in the pipe which results in necking of the pipe at the radial opening of the pipe; and, a traction arm connected to the wedge at the distal end and being removably connected to a drive for pulling the wedge to cause necking of the pipe at the radial opening of the pipe.

5. The device according to claim 4, wherein a series of exchangeable dies are associated with the device, each of the dies having a first section and a second section, each of the second sections having identical dimensions, and each of the first sections having different dimensions to form the series of dies.

6. The device according to claim 4, wherein the body has an outer diameter and the longitudinal passage of the pipe has an inner diameter, the inner diameter being greater than the outer diameter.

7. The device according to claim 4 further comprising an adapter sleeve having an inner diameter and an outer diameter, the outer diameter of the adapter sleeve allowing slidable insertion of the adapter sleeve into the radial opening of the body and the inner diameter of the adapter sleeve being larger than the outer diameter of the die, the die being slidable relative to the body and the sleeve, whereby different sized pipe openings can be necked with the body.

8. The device of claim 4 wherein the wedge has a groove positioned substantially parallel to the contact plane and wherein the die comprises a shoulder which engages the groove in the wedge.

* * * * *

UNITED STATES PATENT AND TRADEMARK OFFICE

CERTIFICATE OF CORRECTION

PATENT NO. : 5,515,710

DATED : May 14, 1995

INVENTOR(S) : Leo LARIKKA

It is certified that error appears in the above-identified patent and that said Letters Patent is hereby corrected as shown below:

On the title page item [73], Assignee:

should read -- Efes Tex AG, Lugano, SWITZERLAND --

Signed and Sealed this

Sixth Day of January, 1998

*Attest:*

Bruce Lehman

BRUCE LEHMAN

*Attesting Officer*

*Commissioner of Patents and Trademarks*